US005526577A

United States Patent [19]

Nix

[11] Patent Number: 5,526,577

[45] Date of Patent: Jun. 18, 1996

[54] SHINGLING DEVICE

[76] Inventor: William R. Nix, 6121 Hogue Rd., Evansville, Ind. 47712

[21] Appl. No.: 336,516

[22] Filed: Nov. 9, 1994

[51] Int. Cl.[6] ..... G01D 21/00

[52] U.S. Cl. ..... 33/648

[58] Field of Search ..... 33/33, 405, 411, 33/646, 647, 648, 649

[56] References Cited

U.S. PATENT DOCUMENTS

| | | | |
|---|---|---|---|
| 54,584 | 5/1866 | Newbank | 33/648 |
| 154,522 | 8/1874 | Schramm et al. | 33/648 |
| 253,816 | 2/1882 | Clark | 33/648 |
| 308,574 | 11/1884 | Poe | 33/648 |
| 738,256 | 9/1903 | Tinklepaugh | 33/648 |
| 760,971 | 5/1904 | Dinwiddle | 33/648 |
| 786,710 | 4/1905 | Anderson | 33/648 |
| 844,612 | 7/1907 | Morris | 33/649 |
| 861,579 | 7/1907 | Edson | 33/649 |
| 1,380,485 | 6/1921 | Langeberg | 33/649 |
| 1,414,556 | 5/1922 | Dresen | 33/649 |
| 1,433,772 | 10/1922 | Barclay | 33/648 |
| 1,521,459 | 12/1924 | McCoy | 33/648 |
| 1,582,620 | 4/1926 | Ostrander | 33/648 |
| 1,750,854 | 3/1930 | Nelson | 33/649 |
| 2,794,261 | 6/1957 | Fudge | 33/648 |

*Primary Examiner*—Christopher W. Fulton
*Assistant Examiner*—G. Bradley Bennett
*Attorney, Agent, or Firm*—Barnes & Thornburg

[57] ABSTRACT

A shingling device is provided for installing shingles on a roof. The shingling device includes a strap having a first end and a second end, the strap including longitudinally spaced apart pin-receiving holes. A strap hanger is appended to the first end. The shingling device further includes a pin sized to be selectively inserted into the pin-receiving holes and the pin is received by a selected pin-receiving hole. In addition, the shingling device includes a transversely elongated shingle holder positioned by the pin once the pin is received by a selected pin-receiving hole. The shingle holder has a bottom plane generally parallel to the roof. The shingle holder also has an elongated lip appended to the shingle holder adjacent to the bottom and angularly extending out of the plane defined by the bottom.

27 Claims, 4 Drawing Sheets

FIG. 5
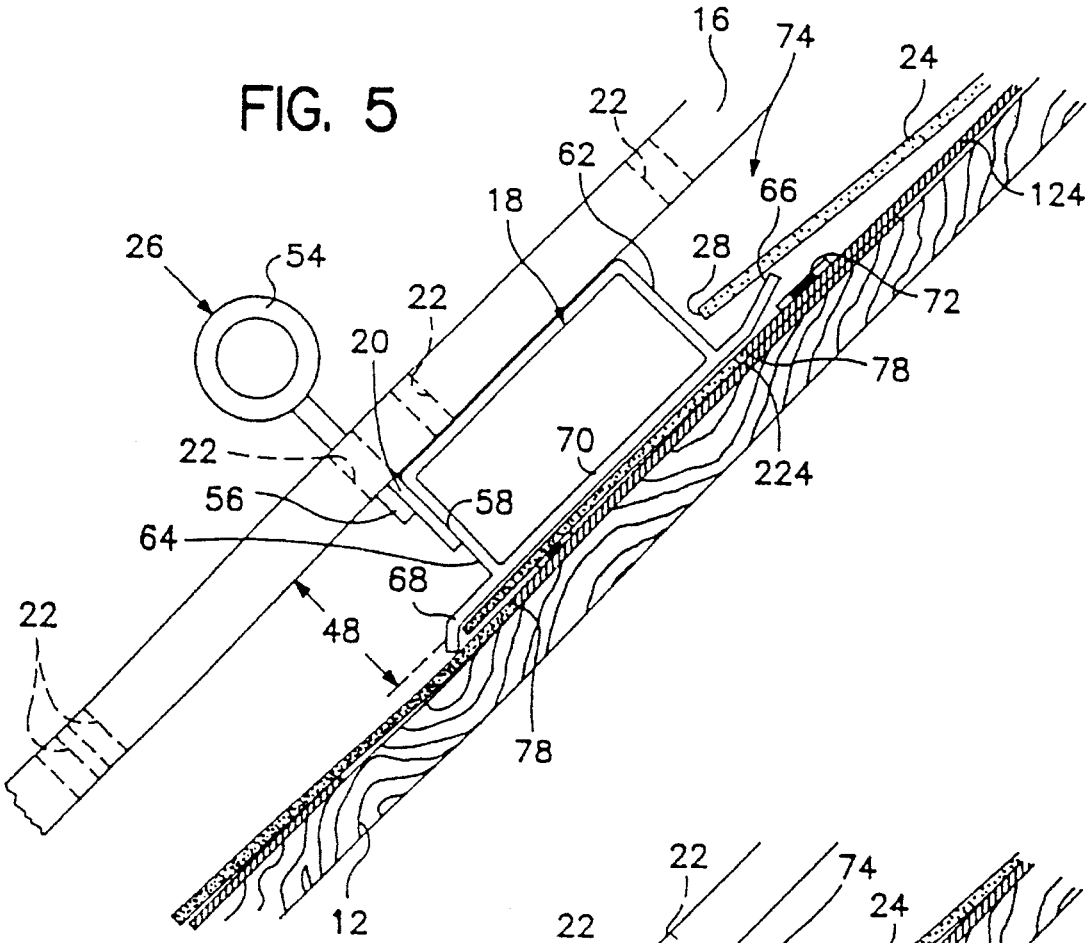
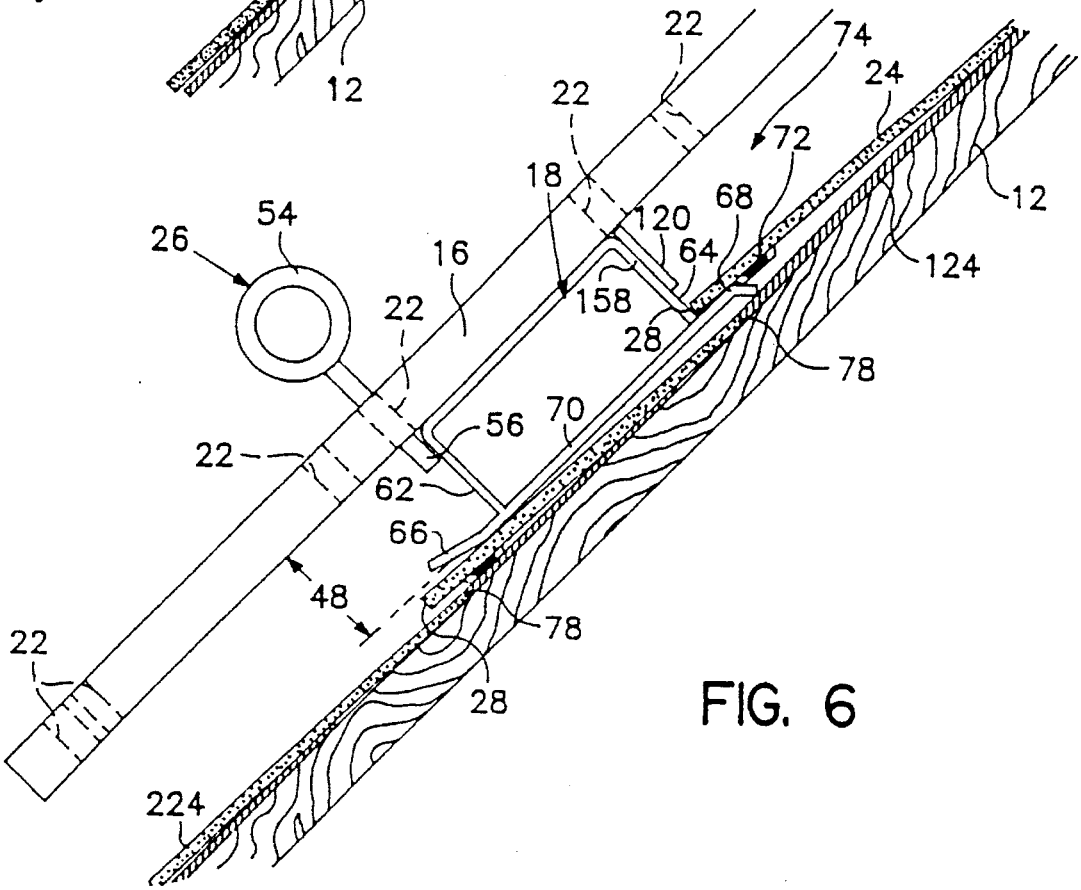
FIG. 6

SHINGLING DEVICE

BACKGROUND AND SUMMARY OF THE INVENTION

The present invention relates to devices used in the construction of structures having a roof and particularly to a shingling device for aligning shingles during the installation of a roof. More particularly, the present invention relates to a device temporarily appended to the roof during the shingling operation to help the installer align each course of shingles to produce straight and repeatable courses of shingles on the roof.

One challenge in the construction of buildings is to produce structures of high functional quality that are aesthetically pleasing. The appearance of the outside of the structure is one significant consideration of potential buyers as they attempt to judge the overall quality of the structure. The roof of a structure including the shingles covering the roof is typically readily observable and shingles that are evenly and neatly installed provide an orderly appearance resulting in a positive first impression of the overall workmanship of the structure.

Two popular methods for determining the placement of shingles include measuring and "snapping" chalking lines on the roof and placing the shingles by hand adjacent to the chalk lines, and placing the shingles by hand adjacent to the cut outs of the course of shingles previously applied. In addition, some manufacturers of shingles provide a color line in the shingles as a guide for fastening. These lines can be very close to the exposure line on the shingles requiring great accuracy in the placement the shingles along a straight line.

The need for a device to help workers install shingles has been recognized in the art and several shingling devices have been developed. For instance, U.S. Pat. No. 54,584 to Newbank, U.S. Pat. No. 154,522 to J. M. & C. T. Schramm, U.S. Pat. Nos. 253,816 to Clark, 308,574 to Poe, 760,971 to Dinwiddie, 786,710 to Anderson, 1,380,485 to Langeberg, 1,433,772 to Barclay, 1,582,620 to Ostrander, and 2,794,261 to Fudge all disclose shingling devices.

What is needed is a shingling device that reduces the time required to install shingles onto a roof while improving the accuracy of shingle placement. Builders would appreciate a shingling device that could accommodate all brands of fiberglass and asphalt shingles and that would install them in accordance with the manufacturer's specification for exposure, as well as a device that is designed for use with shingles having seal-down adhesive applied to either the top or the bottom of the shingle.

Builders would also appreciate a shingling device that is easy and fast to set-up and use that eliminates the need to remeasure and snap a new chalk line for each course of shingles. It would be especially appreciated if the shingling device would hold shingles in place and keep them from sliding out of position during the installation procedure, if it would hold the shingles in a manner that reduces the stress remaining after installation thereby reducing the number of stress points that can propagate deterioration, and if it could be left on a roof overnight without damage to the roof, the shingles, or the shingling device.

According to the present invention, a shingling device for installing shingles on a roof is provided. The shingling device includes a strap having a first end and a second end, the strap being formed to include longitudinally spaced apart pin-receiving holes. A strap hanger is appended to the first end of the strap and a pin sized to be selectively inserted into the pin-receiving holes is provided. A transversely elongated shingle holder is positioned to engage the pin once the pin is received by a pin-receiving hole. The shingle holder has a bottom and an elongated lip is appended to the shingle holder adjacent to the bottom.

In preferred embodiments, a tab is appended to the second end of the shingle holder and is arranged to extend past the second end to form a shingle holder-receiving surface. In addition, the lip can angle downwardly and away from the shingle holder or it can angle upwardly and away from the shingle holder, depending upon whether shingles with seal-down adhesive are being installed and whether the adhesive is on the top or the bottom of the shingles. If the adhesive is supplied on the top of the shingles, then the lip that extends upwardly and away from the shingle holder is used to hold the course of shingles being installed away from the previously installed shingles while also preventing contact of the adhesive to the shingle holder. If the adhesive is supplied on the bottom of the shingles, then the lip that extends downwardly and away from the shingle holder is used to achieve the same objective.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 5 is a sectional view taken along line 5—5 of FIG. 3 showing an upwardly extending lip of the shingle holder holding a course of shingles being installed away from both a previously installed course of shingles and seal-down adhesive present on the tops of the previously installed course of shingles; and FIG. 6 is a sectional view taken along line 6—6 of FIG. 4 showing a downwardly extending lip of the shingle holder holding both the course of shingles being installed and the seal-down adhesive present on the bottoms of the shingles being installed away from the previously installed course of shingles.

DETAILED DESCRIPTION OF THE DRAWINGS

Figure 1:
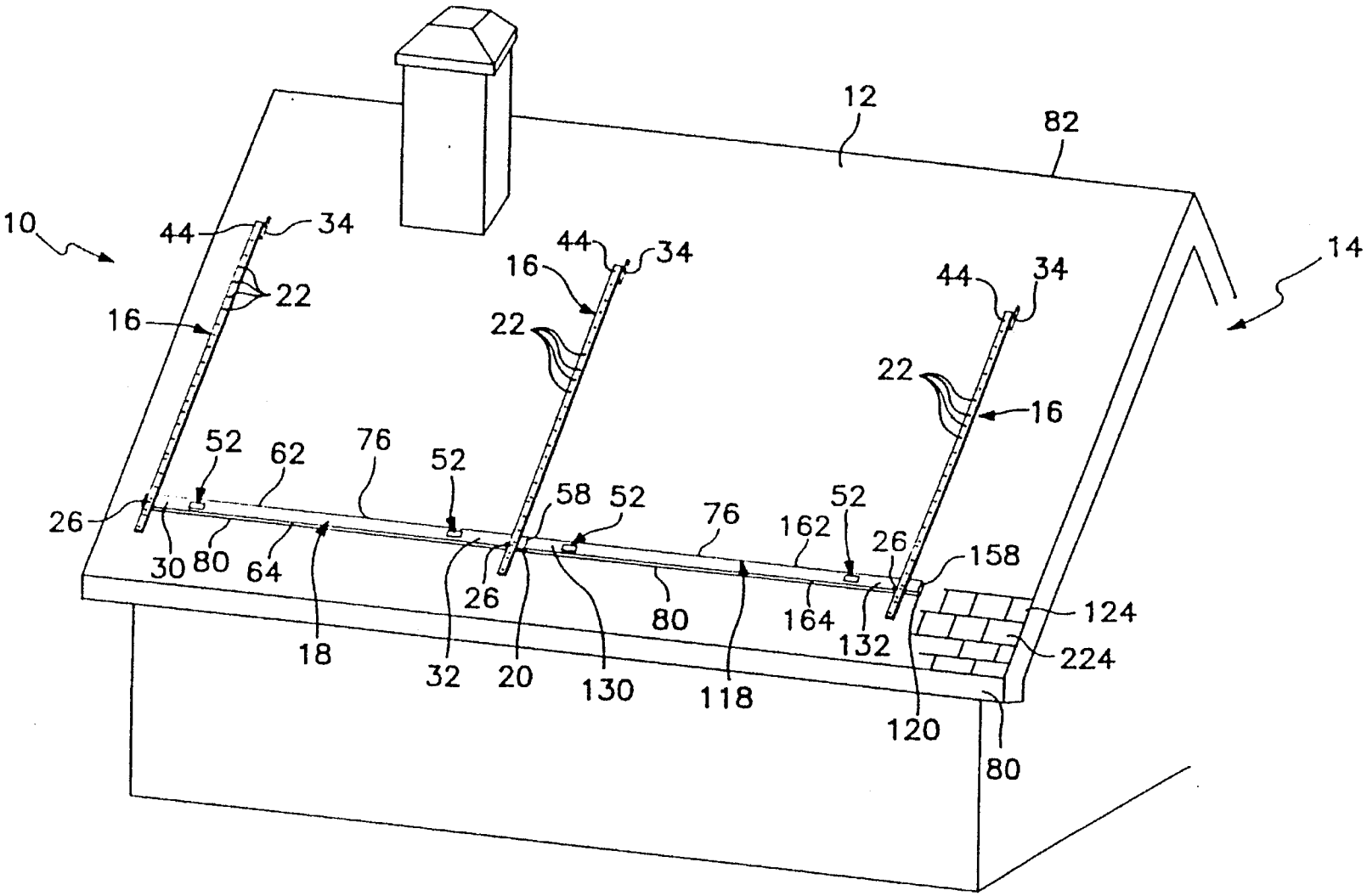
FIG. 1 is a perspective view of a structure having a roof showing a shingling device in accordance with the present invention including two horizontal shingle holders and three vertical straps temporarily appended to a roof and holding the shingle holders in position on the roof.

An illustration of a shingling device 10 in accordance with the present invention is shown in FIG. 1 temporarily mounted to the roof 12 of a structure 14 to be shingled. The illustrative shingling device 10 shows three straps 16 and two shingle holders 18, 118, though any number of shingle holders 18, 118 can be used to extend as far as desired across the roof 12 of the structure 14.

Tabs 20, 120 are appended to the shingle holders 18, 118. The tabs 20, 120 are arranged to include a shingle holder-receiving surface 58, 158 to engage and support a second shingle holder 118 adjacent to a first shingle holder 18. The use of tabs 20, 120 reduces the number of straps 16 required for use with the shingling device 10. The number of straps 16 required to support the shingle holders 18, 118, instead of being two straps 16 for each shingle holder 18, 118, will be just one strap more than the total number of shingle holders 18, 118 being supported.

The straps 16 are formed to include pin-receiving holes 22. A pin 26 is received by the pin-receiving holes 22 in each strap 16 and the shingle holder 18 rests against the pins 26. The first shingle holder 18 engages pins 26 received by two different straps 16. The pins 26 are arranged to hold the shingle holder 18 at a desired angle, typically parallel to the eave 80 of the roof 12. The ends 28 of shingles 24 to be installed rest against the shingle holder 18 and are thereby aligned by the shingle holder 18 as the shingles 24 are installed.

Figure 3:
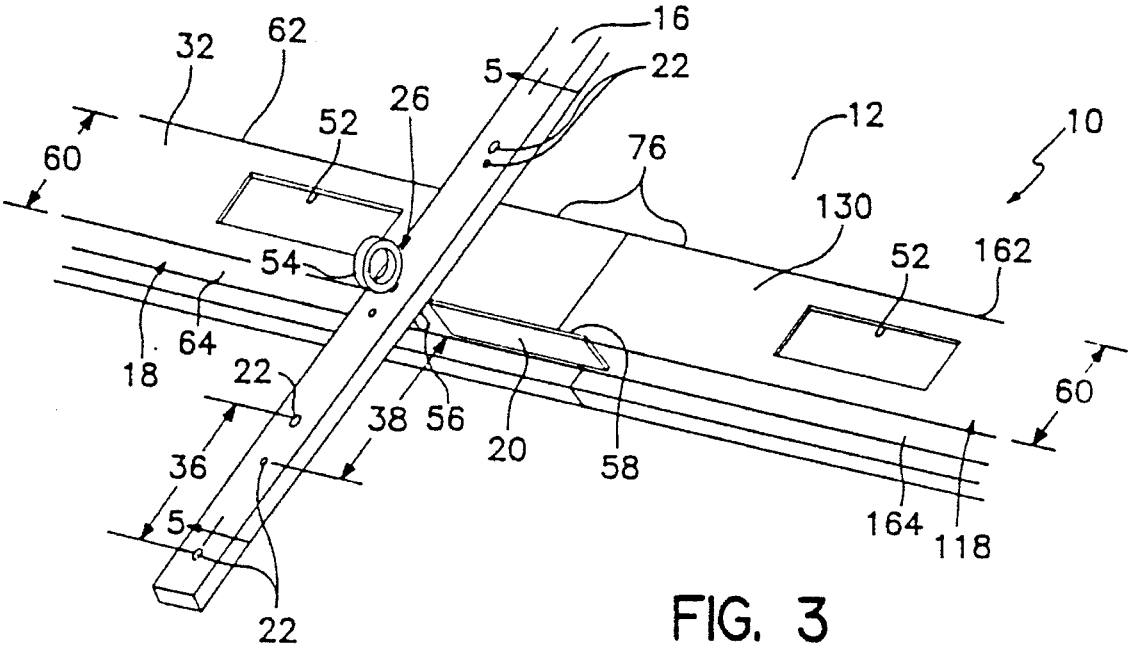
FIG. 3 is a perspective view of the end of the strap adjacent to the eave of the roof showing the shingling device of the present invention in a first configuration having a pin located in a pin-receiving hole supporting one end of a first elongated shingle holder and a tab appended to the end of the first shingle holder and supporting one end of a second elongated shingle holder.
Figure 4:
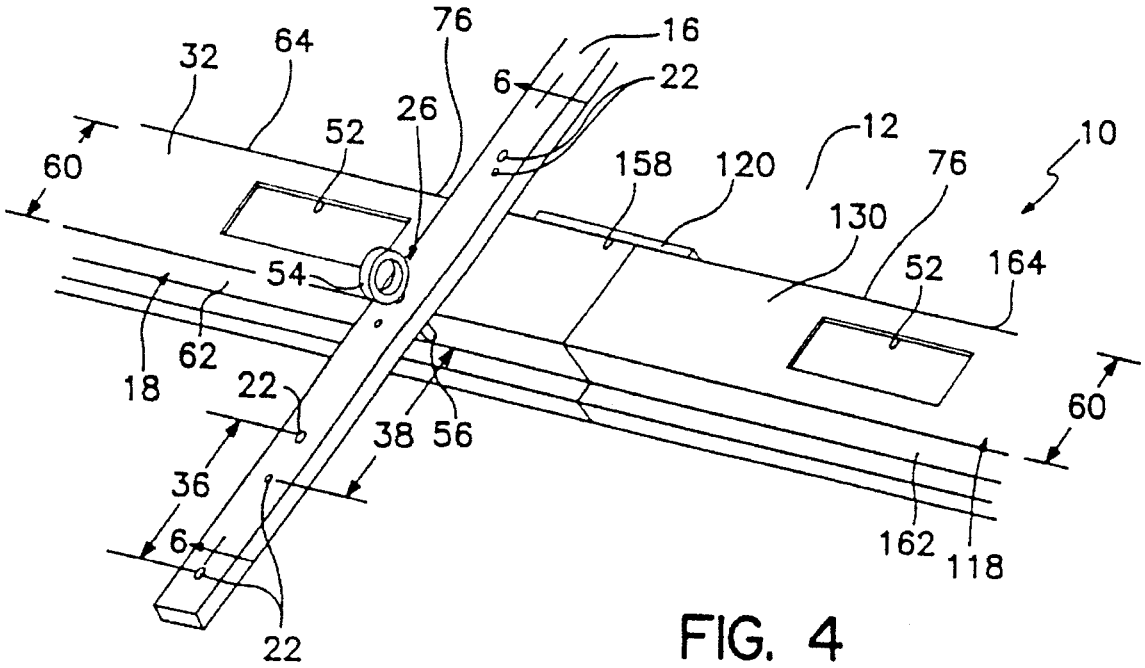
FIG. 4 is a perspective view of the end of the strap adjacent to the eave of the roof showing the shingling device in a second configuration having the pin located in the pin-receiving hole supporting the end of a first shingle holder and the tab appended to the top side on the end of the second shingle holder, the tab supporting the end of the second shingle holder by resting against the end of the first shingle holder.

The pin-receiving holes 22 are spaced apart so that the shingling device 10 can accept shingles 24 that are both 5 inches (12.7 cm) in length 36 and 5⅝ inches (14.3 cm) in length 38, as shown best in FIGS. 3 and 4. Spacings 36, 38 of the pin-receiving holes 22 are arranged to accommodate the shingle manufacturers' guidelines regarding shingle exposure. As shown best in FIGS. 5 and 6, the pin-receiving holes 22 are arranged so that the ends 28 of the shingles 24 cover the exposure lines 78 on the previously installed course of shingles 124. Though the preferred embodiment of the shingling device 10 includes straps 16 having pin-receiving holes 22 spaced apart to accept shingles 24 that are both 5 inches (12.7 cm) in length 36 and 5⅝ inches (14.3 cm) in length 38, the pin-receiving holes 22 can be spaced apart at any desired spacing to accept shingles 24 of any dimension or to place shingles 24 at any desired interval.

Additional shingle holders 118 may be used with the shingling device 10. The shingle holders 18, 118 are designed for use in two configurations described below. In the first configuration, shown best in FIGS. 1, 3, and 5, the second shingle holder 118 has a first end 130 that rests against the tab 20 appended to a second side 64 of the first shingle holder 18 facing the eave 80 of the roof 12. The first end 130 of the second shingle holder 118 is held against the tab 20 appended to the first shingle holder 18 by gravity as a result of the slope of the roof 12 upon which the shingling device 10 is fixed. The second end 32 of the second shingle holder 118 rests against a pin 26 received by a pin-receiving hole 22 in a third strap 16 appended to the roof 12.

In the second configuration, shown best in FIGS. 4 and 6, the second shingle holder 118 has a first end 130. A tab 120 is appended to a second side 164 of the first end 130 of the second shingle holder 118 facing the peak 82 of the roof 12. The tab 120 is arranged so that the shingle holder-receiving surface 158 of the tab 120 rests against a second side 64 of the second end 32 of the first shingle holder 18. The tab 120 of the second shingle holder 118 is held against the second end 32 of the first shingle holder 18 by gravity as a result of the slope of the roof 12 upon which the shingling device 10 is fixed. The second end 132 of the second shingle holder 118 rests against a pin 26 received by a pin-receiving hole 22 in a third strap 16 appended to the roof 12.

The tabs 20, 120 are arranged so that the second shingle holder 118 will be aligned with the first shingle holder 18. The width 60 of the shingle holders 18 is uniform and the shingle holder-receiving surface 58, 158 is arranged so that first sides 62, 162 and the second sides 64, 164 of the shingle holders 18, 118 are even and uniform across the roof 12. The even and uniform alignment of the sides 62, 162 and 64, 164 provides an even and uniform upper straight edge 76 facing toward the peak 82 of the roof 12.

The length of the straight edge 76 will be the additive length of the individual shingle holders 18, 118. Any number of additional shingle holders 18, 118 may be added to the shingling device 10 in the manner described above to accommodate the width of the roof 12, the area of the roof 12 to have shingles 24, installed, and the desires of the workers installing the shingles 24.

Figure 2:
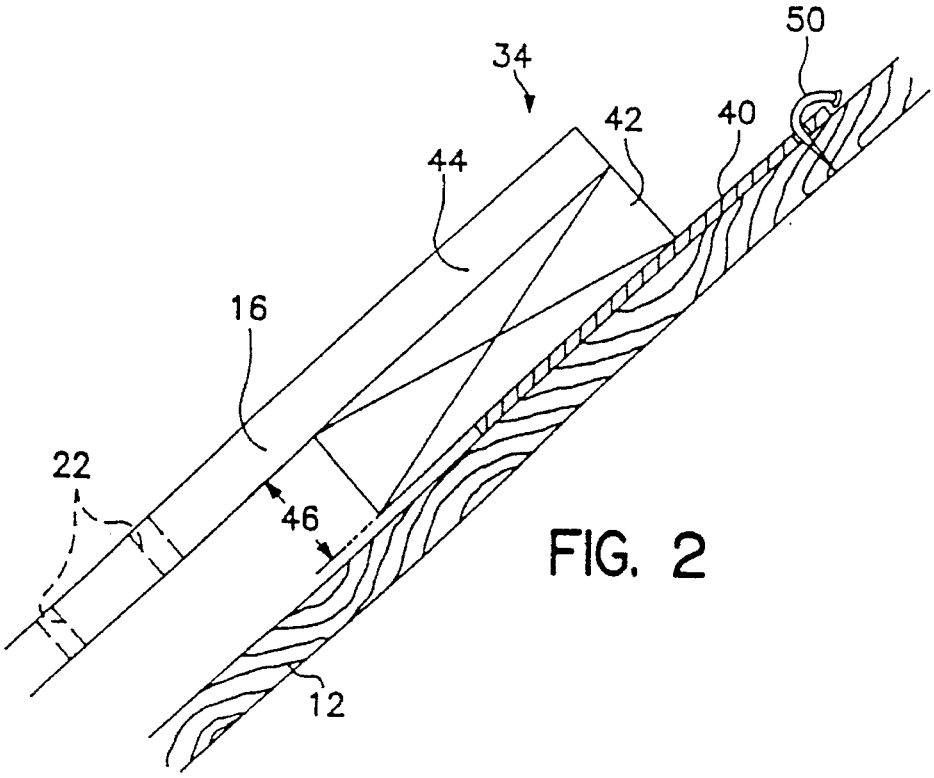
FIG. 2 is a side elevation view of a strap hanger that is used to temporarily append the shingling device to the roof showing the strap hanger nailed to the roof, a spacer appended to the strap hanger, and the strap appended to the spacer and extending down toward the eave of the roof.

The strap hanger 34 includes an anchor piece 40 that is fixed to a spacer 42, shown best in FIG. 2. The spacer 42 is fixed to an upper end 44 of the strap 16. The spacer 42 is sized to have a height 46 equal to the height 48 of the shingle holder 18, 118 to keep the strap 16 generally parallel with the roof 12 during shingling. The anchor piece 40 is temporarily anchored to the roof 12 with a nail 50 that pierces the anchor piece 40 and penetrates the roof 12. Typically a nail is used to anchor the anchor piece 40 to the roof 12, though any suitable means for temporarily anchoring the anchor piece 40 to the roof 12 may be used.

The anchor piece 40 is glued to the spacer 42, though any means for fixing the spacer 42 to the anchor piece 40 such as nailing and riveting may be employed. Likewise, the strap 16 is glued to the spacer 42, though any means for fixing the strap 16 to the spacer 42 such as nailing and riveting may be employed.

The shingle holders 18, 118 are each provided with a handle slot 52 on both the first end 30 and the second end 32, as best shown in FIGS. 3 and 4. The shingle holders 18, 118 are typically made from light weight or extruded metals, plastic or fiberglass, though it can be made from any suitable material apparent to those skilled in the art. The pins 26 include heads 54 and posts 56. The pins 26 are received by pin-receiving holes 22 and the posts 56 extend below the straps 16. The first end 30 of the first shingle holder 18 and the second ends 32, 132 of all of the shingle holders 18, 118 engage the posts 56 and are held against the posts 56 by gravity as the result of the slope of the roof 12 upon which the shingling device 10 is fixed.

A first lip 66 is appended to the first side 62 of the shingle holder 18, and a second lip 68 is appended to a second side 64 of the shingle holder 18, as shown best in FIGS. 5 and 6. The lips 66, 68 are appended to the bottom 70 of the shingle holder 18, 118 and extend outwardly away from the shingle holder 18, 118. The first lip 66 extends upwardly and away from the shingle holder 18, 118 while the second lip 68 extends downwardly and away from the shingle holder 18, 118. The lips 66, 68 act to prevent the shingles 24 from sliding underneath the bottom 70 of the shingle holder 18, 118 during installation of the shingles 24.

The first lip 66 is particularly advantageous for use with shingles 24 manufactured with seal down adhesive 72 applied to the topside of the shingles 24, as illustrated in FIG. 5. When shingles 24 manufactured with seal down adhesive 72 applied to the topside of the shingles 24 are being installed, the shingling device 10 is used in the first configuration described above with the first side 62, 162 of the shingle holder 18, 118 facing toward the peak 82 of the roof 12, as shown in FIGS. 1, 3, and 5.

The upwardly extending first lip 66 holds the shingles 24 upwardly and away from the course of shingles 124 that was immediately previously installed and from the seal down adhesive 72 carried on the shingles 124 as shown best in FIG. 5. For illustrative purposes, shingles 224 which were installed immediately prior to shingles 124 are also shown in FIG. 5. The upward extension of the first lip 66 also advantageously prevents contact between the lip 66 and the seal down adhesive 72. If the lip 66 were to contact and adhere to the seal down adhesive 72, removal of the shingle holder 18, 118 would most likely result in damage to the shingles 124 that were previously installed.

The second lip 68 is particularly advantageous for use with shingles manufactured with seal down adhesive 72 applied to the bottom side of the shingles 24, as illustrated in FIG. 6. When shingles 24 manufactured with seal down adhesive 72 applied to the bottom of the shingles 24 are being installed, the shingling device 10 is used in the second configuration described above with the second side 64, 164 of the shingle holder 18, 118 facing toward the peak 82 of the roof 12, as shown best in FIGS. 4 and 6.

The downwardly extending second lip 68 holds the shingles 24 and the seal down adhesive 72 carried on the shingles 24 upwardly and away from shingles 124 that were previously installed as shown best in FIG. 6. The downward extension of the second lip 68 also advantageously prevents contact between the lip 68 and the seal down adhesive 72.

The height 48 of the shingle holder 18, 118 is arranged to be approximately the same as the height 46 of the spacer 42 so that the strap 16 is positioned to be generally parallel to the roof 12. This arrangement of the strap 16 creates a space 74 adjacent to the juncture of the strap 16 and the shingle holder 18, 118 that permits placement of shingles 24 against the shingle holder 18, 118 underneath the strap 16 during installation of the shingles 24. The presence of the space 74 also permits the shingles 24 to be nailed to the roof without adjusting placement of the nails (not shown) to accommodate the strap 16.

To use the shingling device 10 of the present invention, shingling begins at the eave 80 of the roof 12. The first course of shingles 24 is installed without use of the shingling device 10. Once the first course is complete, the shingle holders 18, 118 are manually held in alignment with the first course of shingles 24 while the anchor pieces 40 are temporarily fixed to the roof 12. The straps 16 can be placed at infinite locations relative to the shingle holders 18, 118 providing significant flexibility for installing shingles 24 on structures 14 having various roof 12 dimensions using the shingling device 10 of the present invention.

The number of straps 16 appended to the roof 12 will depend upon the number of shingle holders 18, 118 to be used. The number of shingle holders 18, 118 to be used will depend upon the width of the roof 12, the area of the roof 12 to have shingles 24 installed, and the preferences of the workers. The number of straps 16 required will be one greater than the number of shingle holders 18, 118 to be used. If one shingle holder 18 is to be used, two straps 16 are required. Illustratively, if four shingle holders 18, 118 are to be used, five straps 16 are required.

Once the straps 16 are in place, pins 26 are placed in the pin-receiving holes 22 corresponding to the course of shingles 24 to be installed. The first shingle holder 18 is placed in engagement with the pins 26 engaging the two left-most straps 16 and gravity holds the shingle holder 18 in engagement with the pins 26.

If the shingling device 10 is to be used in the first configuration, as shown in FIGS. 1, 3 and 5, and a second shingle holder 118 is used, the second side 164 of the first end 130 of the second shingle holder 118 is placed in engagement with the shingle holder-receiving surface 58 on the tab 20 appended to the first shingle holder 18. The second end 132 of the second shingle holder 118 engages a pin 26 received by the strap 16 adjacent to the two straps 16 supporting the first shingle holder 18. Gravity holds the second shingle holder 118 in engagement with the shingle holder-receiving surface 58 on the tab 20 and with the post 56 of the pin 26 received by the third strap 16.

If the shingling device 10 is to be used in the second configuration, as shown in FIGS. 4 and 6, and a second shingle holder 118 is used, the shingle holder-receiving surface 158 of the tab 120 on the first end 130 of the second shingle holder 118 is placed in engagement with the upper side 64 of the second end 32 of the first shingle holder 18. The second end 132 of the second shingle holder 118 engages a pin 26 received by the strap 16 adjacent to the two straps 16 supporting the first shingle holder 18. Gravity holds shingle holder-receiving surface 158 of the tab 120 of the second shingle holder 118 in engagement with the first shingle holder 18 and with the post 56 of the pin 26 received by the third strap 16.

Once all shingle holders 18, 118 are in place forming even and uniform straight edges along the first sides 62, 162, and the second sides 64, 164, the installation of the shingles 24 may begin. Whether the shingling device 10 is used in the first configuration described above having the first sides 62, 162 facing the peak 82 of the roof 12 and forming the straight edge 76 as shown in FIGS. 1, 3, and 5, or in the second configuration having the second sides 64, 164 facing the peak 82 of the roof 12 and forming the straight edge 76 as shown in FIGS. 4 and 6, depends upon whether shingles 24 with seal down adhesive 72 are used and on which sides of the shingles 24 the seal down adhesive 72 is applied, as discussed above.

Shingles 24 are laid across the straight edge 76 facing the peak 82 of the roof 12. The shingles 24 rest against the straight edge 76, held in place only by gravity. The workers installing the shingles 24 nail the shingles 24 into place while the shingles 24 rest against the straight edge 76. Advantageously, the shingles 24 are fastened to the roof 12 with a minimum of stress in them due to the holding action along the base of the shingles 24. This is advantageous because shingles 24 installed with stress in them will eventually crack at stress points and deteriorate.

After the course of shingles 24 has been installed, the workers installing the shingles 24 simply move the pins 26 to the appropriate pin-receiving holes 22 for the next course of shingles 24, place the shingle holders 18, 118 into engagement with the pins 26, and begin installing the next course of shingles 24. This procedure, made possible through the use of the shingling device 10 of the present invention, saves a great deal of time over the currently popular method of remeasuring the location for the next course of shingles 24, snapping a chalk line to mark the location for the next course, and then holding the shingles 24 along the chalk line while nailing the shingles 24 to the roof 12.

Use of the shingling device 10 of the present invention also provides for greater accuracy in the placement of shingles 24. This accuracy helps to assure that the shingle manufacturers' recommended exposures are adhered to with no significant variation in the exposure for all courses installed on the roof 12 and that the nails in the installed shingles 24 will be covered as recommended by most shingle manufacturers, resulting in a neat appearance and a high quality roof 12. It also provides for excellent nesting when installing shingles 24 on top of shingles 24 previously installed using the shingling device 10 of the present invention.

In addition to the advantages described above, workers installing shingles 24 will appreciate the ruggedness and versatility of the design of the shingling device 10 of the present invention. The shingling device 10 can be left on a roof 12 overnight or in inclement weather without damage to the shingling device 10 and without the shingling device 10 causing damage to the roof 12 or the shingles 24. The weight of the shingles 24 on the shingle holder 18 will not cause deflections or warpage of the shingle holder 18, which could cause uneven courses of shingles 24, even on a roof plane as steep as a mansard roof. Also, if one portion of a roof plane is to be shingled at one time and another portion of the roof plane is to be shingled at another time, reconnecting the shingling device 10 for the second portion of the roof plane can be accomplished without causing discernible irregularities in the shingle pattern at the point where the two portions meet.

Although the invention has been described in detail with reference to a preferred embodiment, additional variations and modifications exist within the scope and spirit of the invention as described and defined in the following claims.

I claim:

1. A shingling device for installing shingles on a roof, the shingling device comprising a strap having a first end and a second end, the strap including longitudinally spaced apart pin-receiving holes, a strap hanger appended to the first end, a pin sized to be selectively inserted into the pin-receiving holes, a transversely elongated shingle holder positioned by the pin once the pin is received by a selected pin-receiving hole, the shingle holder having a bottom plane generally parallel to the roof, and an elongated lip appended to the shingle holder adjacent to the bottom and angularly extending out of the plane defined by the bottom.

2. The shingling device of claim 1, wherein the shingle holder further includes an end and a tab is appended to the end of the shingle holder and is arranged to extend past the end to form a shingle holder-abutting surface.

3. The shingling device of claim 1, wherein the lip angles downwardly toward the roof.

4. The shingling device of claim 1, wherein the lip angles upwardly away from the roof.

5. The shingling device of claim 1, wherein the shingle holder is positioned by abutment with the pin.

6. A shingling device for installing rows of shingles having adhesive applied thereto on a roof, the shingling device comprising a strap having a first end and a second end, the strap including longitudinally spaced apart pin-receiving holes, a strap hanger appended to the first end, a pin sized to be selectively inserted into the pin-receiving holes, a transversely elongated shingle holder positioned by the pin, and an angular member appended to the shingle holder for holding shingles having adhesive thereon that are to be adhesively installed away from shingles previously installed to prevent undesired contact between shingles being installed, the adhesive, and shingles previously installed.

7. The shingling device of claim 6, wherein the shingle holder includes means for positioning a second shingle holder appended to the shingle holder.

8. The shingling device of claim 6, wherein the angular member includes means for preventing shingles from slipping beneath the shingle holder.

9. The shingling device of claim 6, wherein the shingle holder is positioned by abutment with the pin.

10. The shingling device of claim 6, wherein the means for holding shingles prevents undesired contact between the adhesive and the shingle holder.

11. A shingling device for installing rows of shingles on a roof, the shingling device comprising a strap having a first end and a second end, the strap including longitudinally spaced apart pin-receiving holes, a strap hanger appended to the first end, a pin sized to be selectively inserted into the pin-receiving holes, a transversely elongated shingle holder positioned by the pin, the shingle holder having an end, and a tab attached to the end of the shingle holder and extending past the end to form a surface abutting an additional shingle holder.

12. The shingling device of claim 6, wherein the shingles are manufactured with seal-down adhesive and the shingle holder includes means for preventing the adhesive from contacting both the shingle holder and a previously installed course of shingles.

13. The shingling device of claim 12, wherein the seal-down adhesive is applied to the tops of the shingles.

14. The shingling device of claim 12, wherein the seal-down adhesive is applied to the bottoms of the shingles.

15. The shingling device of claim 12, wherein the contact-preventing means includes means for preventing shingles from slipping beneath the shingle holder.

16. The shingling device of claim 11, wherein the shingle holder includes means for preventing shingles from slipping beneath the shingle holder.

17. A shingling device for installing rows of shingles on a roof, the shingles having exposed adhesive applied thereto, the shingling device comprising means for aligning the roof shingles, means for mounting the aligning means to the roof, means for holding roof shingles during installation appended to the aligning means, and an angled member preventing contact between the exposed adhesive, shingles being installed and a row of shingles previously installed, the angled member being appended to the holding means.

18. The shingling device of claim 17, wherein means for positioning additional holding means is appended to the holding means.

19. The shingling device of claim 17, wherein the angled member includes means for preventing shingles from slipping beneath the aligning means.

20. A shingling device for holding and aligning roof shingles during the installation of shingles on a roof having a peak, the shingling device comprising a transversely elongated shingle holder positioned to lie on the roof, the shingle holder having an elongated upper side facing the peak of the roof, and an elongated lower side spaced-apart from the upper side, a tab appended to the lower side and extending therefrom to form a shingle holder-receiving surface configured to abut a second shingle holder, an elongated first lip appended to the upper side of the shingle holder and projecting toward the roof, and an elongated second lip appended to the lower side of the shingle holder and projecting away from the roof.

21. A shingling device for installing rows of shingles on a roof, the shingling device comprising a strap having a first end and a second end, the strap including longitudinally spaced apart pin-receiving holes, an elongated bar for holding shingles, the bar having an upper side facing the peak of the roof and a lower side opposite the upper side, and a pin extending in a direction perpendicular to the roof and received in a pin receiving hole, the lower side of the bar abutting the pin.

22. The shingling device of claim 21, wherein the bar includes a bottom parallel to the roof and further comprising a lip appended to the bottom and extending in a direction toward the peak of the roof and out of the plane of the bottom of the bar.

23. The shingling device of claim 21, wherein the bar includes an end, and further comprising a tab attached to the end and extending in a direction parallel to the bar past the end of the bar forming a bar-receiving surface thereon and a second bar extending in a direction parallel to the first bar and engaging the bar-receiving surface.

24. A shingling device for installing shingles on a roof, the shingling device comprising a strap having a first end and a second end, the first end being configured for coupling to a roof, an elongated shingle holder coupled to the strap, the shingle holder having a bottom defining a bottom plane generally parallel to the roof, and an elongated lip appended to the shingle holder adjacent to the bottom and angularly extending with respect to the bottom plane.

25. The shingling device of claim 24, wherein the shingle holder is positioned to lie beneath the strap.

26. The shingling device of claim 25, wherein the strap includes a plurality of pin-receiving openings and further comprising a pin extending in a direction perpendicular to the roof and received in one of the pin-receiving openings, the shingle holder abutting the pin.

27. The shingling device of claim 26, wherein the shingle holder includes an end, and further comprising a tab attached to the end of the shingle holder and extending in a direction parallel to the shingle holder past the end of the shingle holder to form a shingle holder-abutting surface thereon.

* * * * *